US008875947B2

(12) United States Patent
Obrist et al.

(10) Patent No.: US 8,875,947 B2
(45) Date of Patent: Nov. 4, 2014

(54) DUAL DISPENSING APPARATUS

(75) Inventors: Manfred Obrist, Lustenau (AT); Ralf Seifer, Sargans (CH)

(73) Assignee: Sulzer Mixpac AG, Haag (CH)

( * ) Notice: Subject to any disclaimer, the term of this patent is extended or adjusted under 35 U.S.C. 154(b) by 0 days.

(21) Appl. No.: 13/250,461

(22) Filed: Sep. 30, 2011

(65) Prior Publication Data

US 2012/0097708 A1 Apr. 26, 2012

(30) Foreign Application Priority Data

Oct. 21, 2010 (EP) ..... 10188394

(51) Int. Cl.
*B67D 7/70* (2010.01)
*B65D 81/32* (2006.01)

(52) U.S. Cl.
CPC ..... *B65D 81/325* (2013.01)
USPC ..... 222/137; 222/145.1; 222/145.6

(58) Field of Classification Search
CPC ..... B05C 17/00553; B65D 81/325
USPC ..... 222/137, 390, 386, 386.5, 135, 145.1, 222/145.6; 604/220
See application file for complete search history.

(56) References Cited

U.S. PATENT DOCUMENTS 3,291,128 A * 12/1966 O'Neil ..... 604/125
3,881,484 A * 5/1975 Gidcumb, Jr. ..... 604/89
3,933,273 A * 1/1976 Cox ..... 222/1
4,538,920 A * 9/1985 Drake ..... 366/181.5
4,562,844 A * 1/1986 Carpenter et al. ..... 600/488
4,758,232 A * 7/1988 Chak ..... 604/220
RE33,821 E * 2/1992 Banks ..... 604/110
5,242,400 A * 9/1993 Blake et al. ..... 604/110
5,401,169 A * 3/1995 Fleisher et al. ..... 433/90
5,443,181 A * 8/1995 Popp et al. ..... 222/95
5,485,853 A * 1/1996 Stubbs ..... 600/565
5,622,288 A * 4/1997 Boring ..... 222/327
5,873,490 A * 2/1999 Walpole ..... 222/95
6,176,396 B1 * 1/2001 Hamada et al. ..... 222/137
6,213,633 B1 * 4/2001 Kramer et al. ..... 366/339

(Continued)

FOREIGN PATENT DOCUMENTS

DE 202006015457 2/2008
EP 1746045 1/2007

OTHER PUBLICATIONS

EP Search Report for corresponding European Patent Application No. 10188394 dated Mar. 15, 2011.

*Primary Examiner* — Kevin P Shaver
*Assistant Examiner* — Robert Nichols, II
(74) *Attorney, Agent, or Firm* — K&L Gates LLP

(57) ABSTRACT

A dual dispensing apparatus for dispensing two flowable components having a first storage chamber for the first component, and a second storage chamber for the second component. The two storage chambers are arranged next to one another and each have an outlet for the first or the second component respectively at their distal ends. The apparatus also has a first plunger for penetrating into the first storage chamber and a second plunger for penetrating into the second storage chamber. A respective piston for dispensing the respective component is molded to each plunger and is sealingly guided by the respective wall of the storage chamber. Each storage chamber has at least one first guide element at its end remote from the outlet and each plunger has at least one second guide element adjacent to the respective piston. The first and the second guide elements are configured for mutual engagement.

15 Claims, 6 Drawing Sheets

(56) References Cited

U.S. PATENT DOCUMENTS

Figure 1:
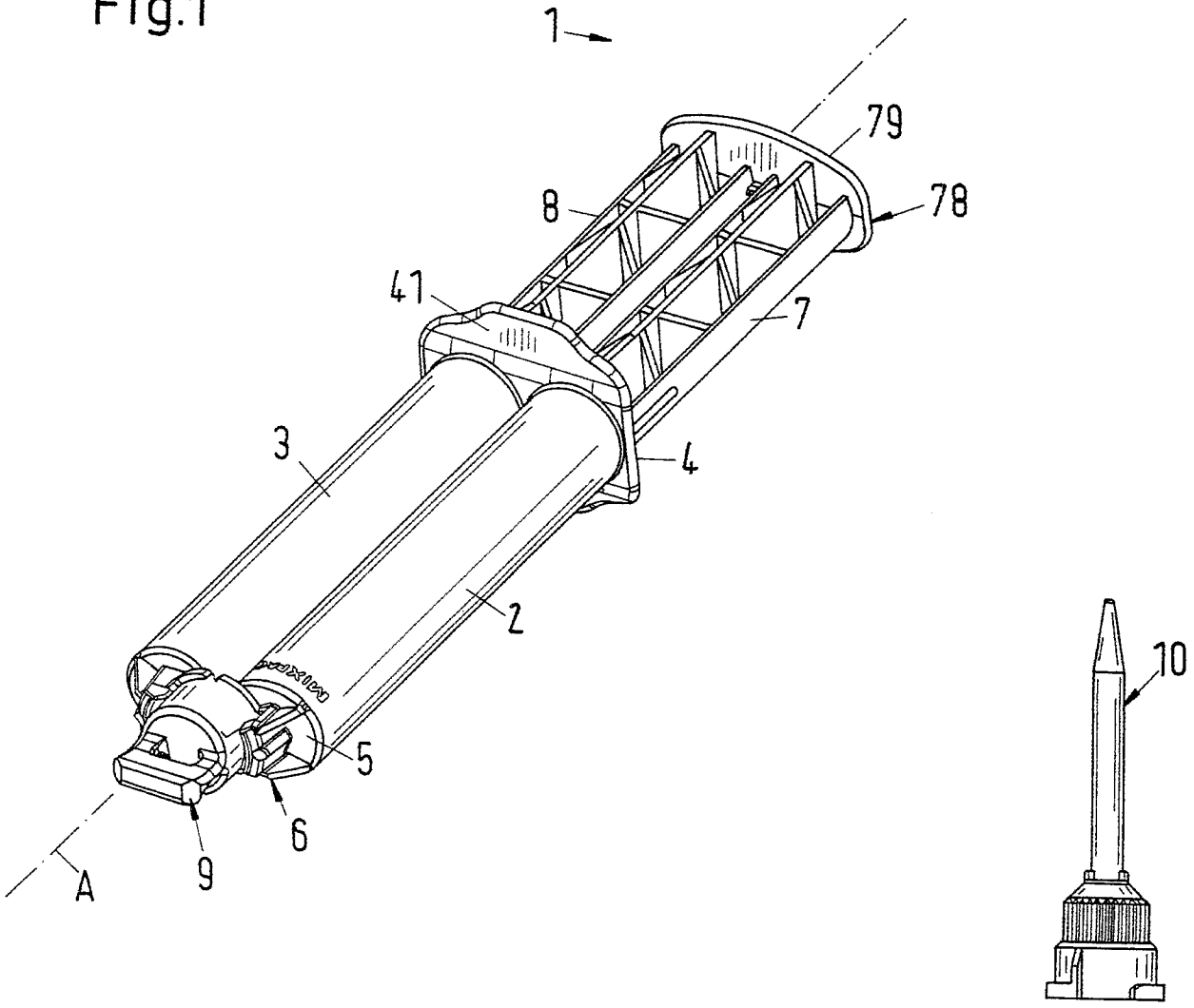

| | | | | |
|---|---|---|---|---|
| 7,194,847 | B2 * | 3/2007 | Summons et al. | 53/433 |
| 7,575,131 | B2 * | 8/2009 | Feinberg et al. | 222/137 |
| 8,096,449 | B2 * | 1/2012 | Keller | 222/137 |
| 8,104,642 | B2 * | 1/2012 | Bambrick et al. | 222/82 |
| 8,197,451 | B2 * | 6/2012 | Zihlmann et al. | 604/220 |
| 2003/0050597 | A1 * | 3/2003 | Dodge et al. | 604/82 |
| 2003/0197024 | A1 * | 10/2003 | Sawhney et al. | 222/137 |
| 2007/0017931 | A1 | 1/2007 | Sogaro | |
| 2011/0198370 | A1 * | 8/2011 | Ho et al. | 222/137 |

* cited by examiner

DUAL DISPENSING APPARATUS

PRIORITY CLAIM

The present application claims priority to European Patent Application No. 10188394.0filed on Oct. 21, 2010, the disclosures of which are incorporated herein by reference.

The invention relates to a dual dispensing apparatus for dispensing two flowable components in accordance with the preamble of the independent claim.

Dual dispensing apparatus such as dual syringes are frequently used for storing and for dispensing two-component systems in which the two components should only come into contact with one another for the respective application in order then to harden, for example. For this purpose, two mutually separate storage chambers are provided of which each contains one of the two components. A plunger having a piston is provided in each storage chamber to dispense the respective component from the storage chamber through an outlet. The two plungers are usually configured in the form of a dual plunger. These dispensing apparatus are typically provided with a static mixer whose inlet region is connected to the outlets of the two storage chambers. The two components are conveyed in the application case by a pressure action on the two plungers through the respective outlets into the static mixer where the two components are thoroughly mixed and are then dispensed as a homogeneous mass.

The content of such dual syringes is frequently only consumed after a plurality of applications. In such cases, after one application, the static mixer is removed and the dual syringe is provided with a closure cap which closes the two outlets. For the next application, the closure cap is then removed, a new static mixer is placed on and the components are dispensed through the mixer.

A respective piston which is moved by the plunger and which expels the respective component through the outlet is provided in the storage chambers. Apparatus are known for this purpose in which the pistons represent separate components in the respective storage chambers which are then moved by manually or mechanically actuated plungers. However, such apparatus are also known in which the pistons are each molded directly to the plunger, that is the pistons are not separate components, but the plungers are configured as pistons in their end regions.

The seal between the pistons and the wall of the respective storage chamber is of great importance with such dual dispensing apparatus. Problems frequently occur here, in particular with such apparatus in which the pistons are molded to the plungers. Bending and torsional moments are transmitted directly to the pistons by the plungers which serve for the movement of the piston and have the consequence of tilts of the pistons with respect to the longitudinal axis of the respective storage chamber. Unwanted leaks result due to these tilts of the pistons, that is the components located in the storage chambers can pass between the respective piston and the wall of the storage chamber to the end of the storage chamber remote from the outlet and can emerge into the environment there.

This problem should be solved by the present invention. It is therefore an object of the invention to propose a dual dispensing apparatus which can in particular also be configured as a dual syringe in which the pistons are molded to the respective plungers, wherein a better seal is realized between the pistons and the wall of the storage chamber which also remains reliable with bending and torsional moments.

The subject of the invention satisfying this object is characterized by the features of the independent claim.

In accordance with the invention, a dual dispensing apparatus for dispensing two flowable components is therefore proposed having a first storage chamber for the first component, having a second storage chamber for the second component, wherein the two storage chambers are arranged next to one another and each have an outlet for the first or for the second component respectively at their distal ends, having a first plunger for penetrating into the first storage chamber and having a second plunger for penetrating into the second storage chamber, wherein a respective piston for dispensing the respective component is molded to each plunger and is sealingly guided by the respective wall of the storage chamber, wherein each storage chamber hast at least one first guide element at its end remote from the outlet and each plunger has at least one second guide element adjacent to the respective piston, wherein the first and the second guide elements are configured for mutual engagement.

Bending and torsional moments such as can be caused by the actuation of the plungers are at least to a large extent introduced into the wall of the storage chamber by the two respective mutually engaging guide elements, on the one hand at the proximal end of the storage chamber, i.e. the end of the storage chamber remote from the respective outlet and, on the other hand in the vicinity of the end of the plunger configured as a piston, and said bending and torsional elements can—if at all—only act on the end of the respective plunger formed as a piston in a substantially weakened form so that tilts of the piston are substantially reduced or are completely avoided. A considerably improved seal between the piston and the wall of the storage chamber thus results.

In a particularly preferred embodiment, the first guide element is a groove in the wall of the storage chamber and the second guide element is a web which can engage into the groove. This cooperation between the web and the groove ensures a particularly good transmission of the torsional movements into the wall of the storage chamber.

Advantageously, each web is configured as respectively longer than the groove cooperating with it, for the guide length, that is the path over which the plungers are guided by the groove on their movement in the direction of the respective outlets, can be enlarged by this measure.

It has proven particularly advantageous if each plunger has four webs which are distributed equidistantly over the periphery of the plunger. A particularly good protection of the pistons with respect to tilts can be realized against tilts by this configuration with four grooves and four webs which are arranged offset by 90° with respect to one another with respect to the peripheral direction.

A preferred measure is to configure each groove as running out at its end remote from the respective outlet. The webs can thereby slide more easily out of the respective groove on the plunger movement without degrading the seal.

It has proved advantageous in practice if the length of each groove amounts to at least 15%, preferably at least 20%, of the length of the respective storage chamber. A particularly good guidance of the plungers and a particularly small tilt inclination of the pistons is hereby realized.

In a preferred embodiment, each outlet has a respective circular cross-section. In this respect, the outlets are completely separated from one another so that a cross-contamination between the two outlets is avoided.

The two outlets are preferably parts of a coupling device which is configured for cooperation with a static mixer or a closure cap. The outlets can be connected in a simple manner by this measure to a static mixer for dispensing the components or to a closure cap which closes the outlets up to the next application.

Under practical aspects, it is advantageous due to the simple handling capability if the coupling device is configured for a bayonet connection.

An advantageous measure comprises the fact that the coupling device includes encoding means which is configured for cooperation with encoding elements of a static mixer or of a closure cap. It is thereby ensured that the static mixer or the closure cap can only be connected to the coupling device, and thus to the outlets of the storage chambers, in precisely one orientation. A cross-contamination or a clogging of the outlets can hereby be effectively avoided.

It is advantageous with respect to the storage of the components if a closure cap is provided which is releasably connected to the coupling device and which closes the two outlets.

It is preferred for the dispensing of the two components if a static mixer is provided which is releasably connected to the coupling device, wherein each outlet is connected to an inlet of the static mixer. Such embodiments are also possible in which an adapter is provided between the mixer and the coupling device which has encoding means which cooperate with the encoding means of the coupling device.

Further advantageous measures and embodiments of the invention result from the dependent claims.

Figure 2:
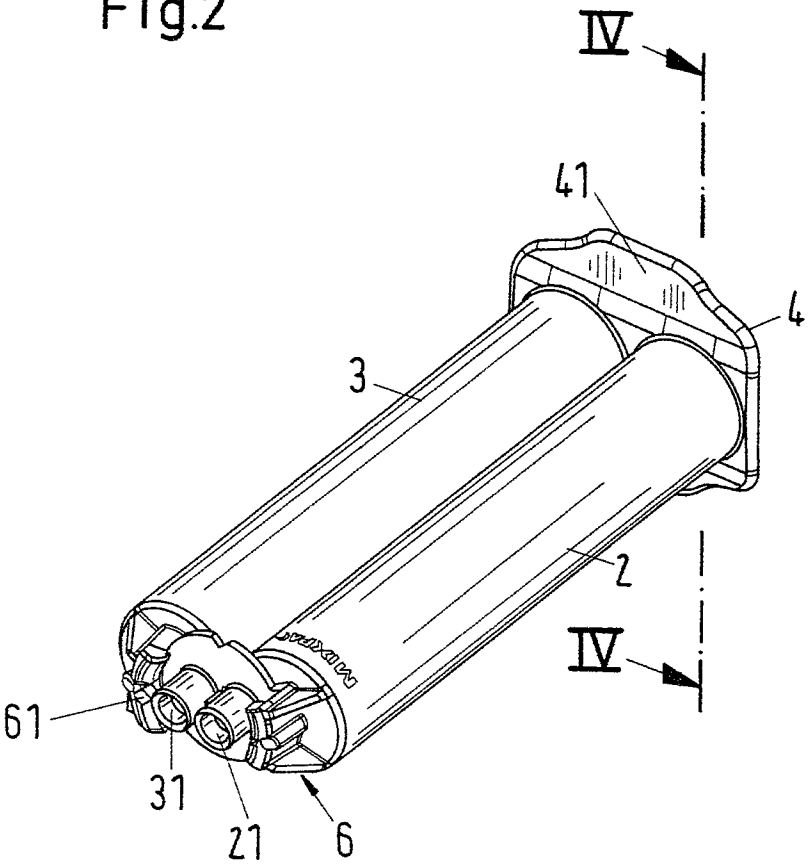
Figure 3:
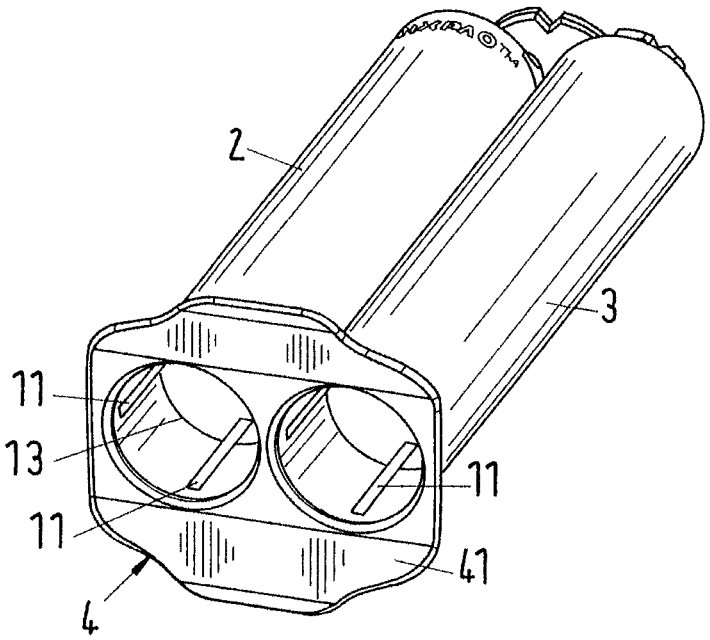
Figure 4:
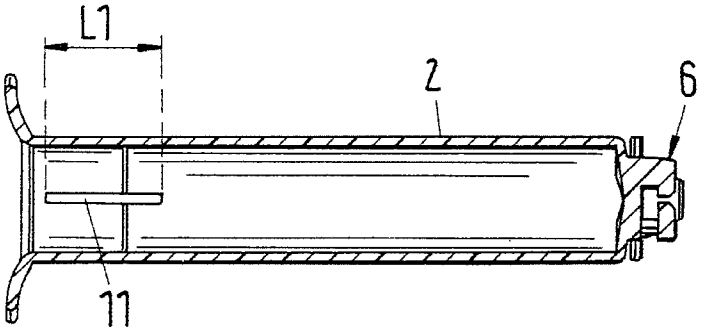
Figure 6:
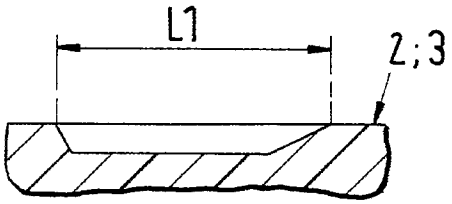
Figure 5:
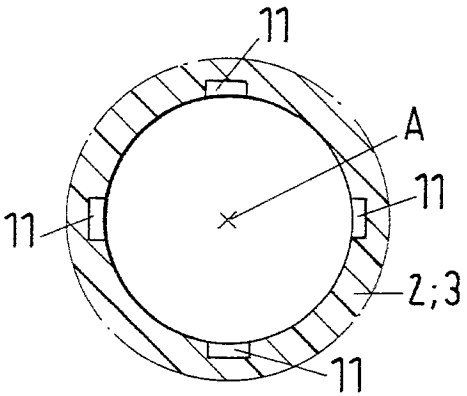
Figure 7:
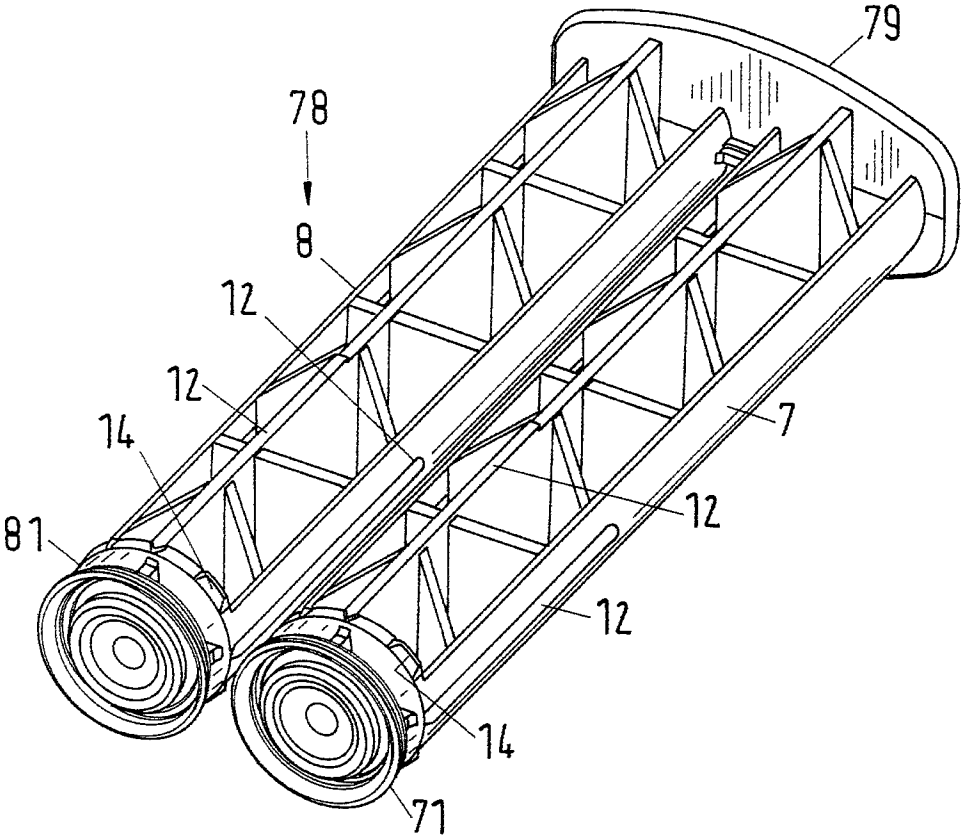
Figure 8:
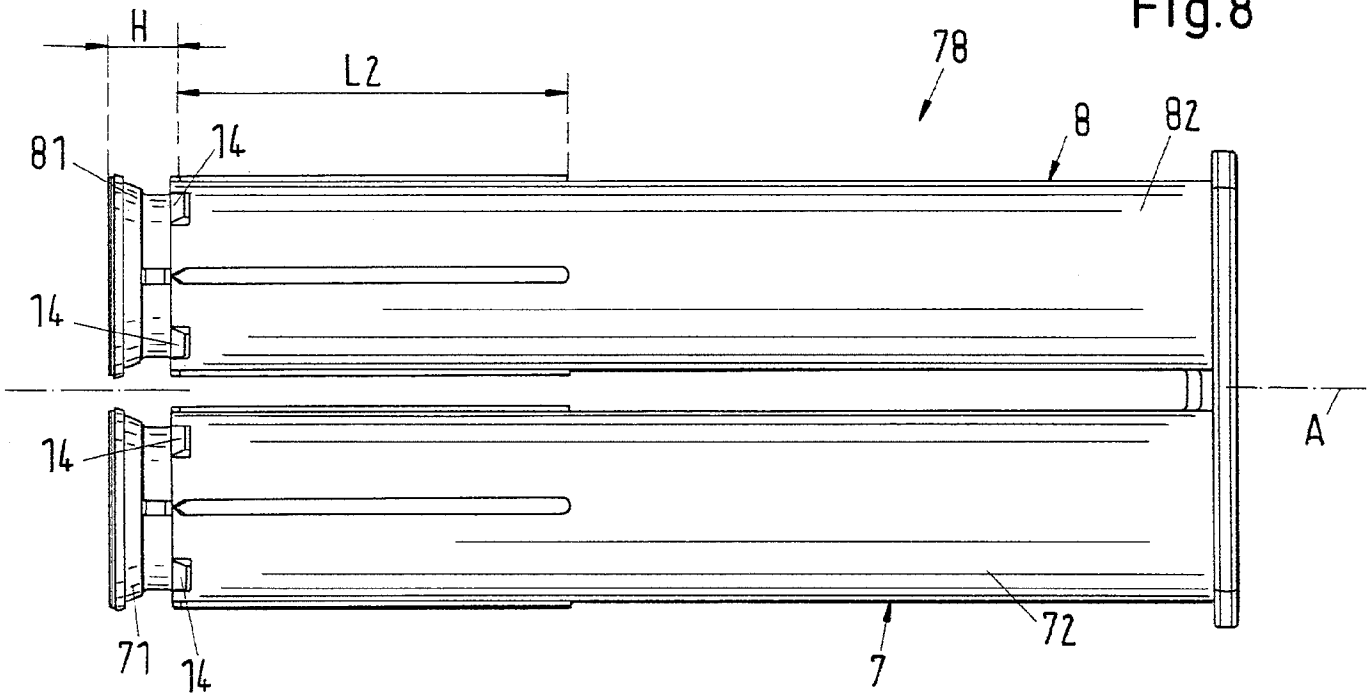

The invention will be explained in more detail in the following with reference to embodiments and to the drawing. There are shown in the schematic drawing, partly in section:

FIG. 1: an embodiment of a dual dispensing apparatus in accordance with the invention in a perspective representation;

FIG. 2: a perspective representation of the storage chambers;

FIG. 3: a perspective view of the storage chambers from the end remote from the outlets with a view into the storage chambers;

FIG. 4: a longitudinal section through one of the storage chambers along the line IV-IV in FIG. 2;

FIG. 5: a schematic cross-sectional representation through one of the two storage chambers in the region of the grooves;

FIG. 6: a section from the wall of a storage chamber with one of the grooves;

FIG. 7: a perspective view of the two plungers of the embodiment;

FIG. 8: a plan view of the two plungers; and

Figure 9:
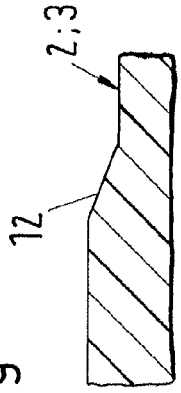

FIG. 9: a section from a plunger which shows one of the webs in section.

FIG. 1 shows, in a perspective representation, an embodiment of a dual dispensing apparatus in accordance with the invention which is designated as a whole by the reference numeral 1 and is configured as a dual syringe 1. The dual syringe 1 is designed for storing and dispensing two flowable components which should only be brought into contact with one another or mixed with one another directly before their application. Such a two-component system is a two-component adhesive, for example. After mixing the two components stored separately from one another, the adhesive hardens and thereby develops its adhesive force.

The dual syringe 1 has two storage chambers arranged next to one another, namely a first storage chamber 2 for a first component and a second storage chamber 3 for the second component, wherein each storage chamber extends in the direction of a longitudinal axis A from a proximal end 4 up to a distal end 5. The storage chambers 2, 3 form a dual cartridge. For better understanding, FIG. 2 shows a perspective representation of the two storage chambers 2, 3 and FIG. 3 shows a perspective view of the storage chambers 2, 3 toward the proximal end 4, with a view into the proximal end region of the two storage chambers 2, 3. The two storage chambers 2, 3 are connected to one another at their proximal ends 4 via a connection piece 41 which is configured as a finger support for the manual actuation of the dual syringe 1.

Each storage chamber 2, 3 has a respective outlet 21, 31 for the first or for the second component at the distal end 5 (see FIG. 2). Each outlet 21, 31 is configured as a separate outlet 21, 31 which in each case has a circular cross-section as a flow cross-section for the respective component. The two components 21, 31 are arranged spaced apart from one another and form the part of a coupling device 6 which is configured for cooperation with a static mixer 10 (see FIG. 1) or with a closure cap 9. FIG. 1 shows the dual syringe 1 having the closed cap 9 placed onto the outlets 21, 31 and locked. In the representation in FIG. 2, this closure cap is removed so that the view of the outlets 21, 31 is free. In this embodiment, the coupling device 6 is configured for a bayonet connection. The closure cap 9 or the static mixer 10 can thus selectively be connected via the coupling device 6 in the form of a bayonet connection to the two outlets 21, 31.

The dual dispensing apparatus 1 furthermore includes a first plunger 7 for penetrating into the first storage chamber 2 as well as a second plunger 8 for penetrating into the second storage chamber 3. In the embodiment described here, the first plunger 7 and the second plunger 8 are configured as a dual plunger 78 in which the two plungers 7, 8 are connected to one another via a common pressure plate 79 at their end not penetrating into the storage chambers 21, 31.

Both the storage chambers 2, 3 and the plungers 7, 8 are preferably manufactured from a plastic, wherein the plastic used for the plungers 7, 8 does not have to be the same as that used for the storage chambers 2, 3. Both the storage chambers 2, 3 forming a dual cartridge and the plungers 7, 8 forming a dual plunger 78 are usually manufactured by means of an injection molding process.

For better understanding, FIG. 7 shows a perspective representation of the two plungers 7, 8 which are formed as a double plunger 78. FIG. 8 furthermore shows a plan view of the two plungers 7, 8 from a direction perpendicular to the longitudinal axis A. As in particular the representations in FIGS. 7 and 8 show, the plungers 7, 8 are each manufactured with a framework structure. This framework structure represents a very good compromise between a material consumption which is as low as possible and a stiffness, in particular a bending stiffness, which is as good as possible. As in particular FIG. 8 also shows, the plungers 7, 8 are each configured over approximately more than half of their peripheries with a throughgoing wall 72, 82. This, on the one hand, facilities the sliding of the plungers 7, 8 in the storage chamber 2, 3 and increases the stiffness of the plungers 7, 8 and, on the other hand, allows the demolding of the dual syringe 78 or of the plungers 7, 8 in the injection molding process.

A piston 71 and 81 respectively is molded to each of the plungers 7, 8, in each case at its end. The pistons 71, 81 serve for the dispensing of the two components from the storage chambers 2 and 3 respectively and are each sealingly guided by the wall of the associated storage chamber 2 and 3 respectively. The pistons 71, 81 are not configured as separate components, but are rather produced in one piece with the plungers 7 and 8 respectively.

To dispense the two components, the closure cap 9 shown in FIG. 1 is first released from the coupling device 6 and thus from the two outlets 21, 31 and the static mixer 10 is connected to the coupling device 6 by means of a bayonet latching. A respective flow communication thereby arises for each of the outlets 21, 31 to an inlet of the static mixer 10 associated therewith. The two plungers 7, 8 are now pressed deeper into the storage chambers 2, 3 associated with them by pressure action onto the pressure plate 79, for example by manual pressing, whereby the two pistons 71, 81 convey the first or the second component respectively through the respective outlet 21 or 31 into the static mixer. The two components are thoroughly mixed in the static mixer 10 in a manner known per se to form a homogeneous mass and then emerge at the end of the static mixer 10 remote from the storage chambers 2, 3 for the application. After the end of the application, the static mixer 10 is removed from the coupling device 6 and is replaced by the closure cap 9 which thus again closes the two outlets 21 and 31.

The coupling device 6 preferably has encoding means 61 which are configured for cooperation with encoding elements of the static mixer 10 or of the closure cap 9 so that the closure cap 9 or the static mixer 10 can only be placed onto the storage chambers or the outlets 21, 23 in precisely one orientation.

In contrast to the dual dispensing embodiments known from the prior art, each storage chamber 2, 3 in the dual dispensing apparatus 1 in accordance with the invention has at its proximal end 4, i.e. the end remote from the outlet 21, 31 respectively, at least one first guide element 11 and each plunger 7, 8 has, adjacent to the respective piston 71, 81, at least one second guide element 12, wherein the first guide element 11 and the second guide element 12 are configured for mutual engagement.

In the embodiment described here, the first guide elements are each grooves 11 in the wall of the storage chambers 2, 3 bounding the inner space and the second guide elements are each webs 12 which are arranged at the outer side of the plungers 71 and 8 respectively and are configured for engaging into the respective grooves 11. Both the grooves 11 and the webs 12 each extend in the direction of the longitudinal axis A.

A much improved and extended guide of the plungers 7, 8, and thus in particular of the pistons 71, 82, results by the mutually engaging grooves 11 and webs 12. Said pistons are much less prone to tilting so that a substantially improved seal results between the pistons 71, 81, on the one hand, and the wall of the storage chamber 2, 3, on the other hand. Bending or torsional moments as well as twisting such as may arise, for example, on the manual actuation of the dual plunger 78 by pressure on the pressure plate 79 are introduced via the cooperating grooves 11 and webs 12 into the wall of the storage chamber 2 or 3 respectively and can thus—if at all—only act on the pistons 71, 81 in a greatly weakened form. The lever arm with which the forces can act on the pistons 71, 81 is in particular reduced with bending moments by the mutually engaging grooves 11 and webs 12, whereby the pistons can be less easily induced to tilt by such forces.

It is possible by this improved resistance to tilts to configure the pistons 71 and 81 with a lower axial height H (see FIG. 8).

In such cases, in which the storage chambers 2, 3 are filled from the proximal end 5, the grooves 11 serve in an advantageous manner for the venting on the insertion of the plungers 7, 8 into the storage chambers 2, 3 after ending the filling.

In the embodiment described here, four respective webs 12 are provided at each plunger 7 or 8 respectively and are distributed equidistantly over the periphery of the respective plunger 7, 8, i.e. adjacent webs 1 2 of a plunger 7 or 8 have a spacing of 90° in each case with respect to the peripheral direction. FIG. 9 shows in a sectional representation for better understanding section from a plunger 7 or 8 in which one of the webs 12 is shown in section.

In accordingly the same manner, four respective grooves 11 are provided in each of the storage chambers 2, 3 and are distributed equidistantly over the inner wall of the substantially cylindrical storage chamber 2 and 3. To illustrate this even more clearly, FIG. 4 shows a longitudinal section through one of the storage chambers 2, 3 along the line IV-IV and FIG. 5 shows a schematized cross-sectional representation perpendicular to the longitudinal axis A through one of the two storage chambers 2 or 3 in the region of the grooves 11. FIG. 6 furthermore shows, in a sectional representation, a section of the wall of one of the two storage chambers 2 or 3 with one of the grooves 11.

As in particular FIG. 4 shows, the grooves 11 each start in the proximity of the proximal end 4 and extend from there in the direction of the longitudinal axis A over a length L1.

At the inner wall of each storage chamber 2, 3, a retention portion 13 is furthermore provided in the region of the proximal end 4 which is configured as ring-shaped rib which projects slightly into the inner space of the storage chamber 2, 3 and which extends along the total inner periphery of the storage chamber 2, 3 in the peripheral direction. Each of the grooves 11 is arranged so that it crosses the retention portion 13, that is the grooves 11 each start with respect to the axial direction defined by the longitudinal axis A on the one side of the retention portion 13 and end on the other side of the retention portion 13.

The webs 12 at the plungers 7, 8 (see in particular FIG. 8) each start at the end of the piston 71, 81 remote from the outlet 21, 31, that is where the piston 71 or 81 respectively merges into the rest of the plunger 7 and 8 respectively and extend from there in the direction of the longitudinal axis A over a length L2 toward the common pressure plate 79. In the same axial position at the end of the piston 71 and 81 respectively, where the webs 12 start, a plurality of latch noses 14 are provided at the periphery of the plunger 7 and 8 which cooperate with the retention portion 13 to make an unintentional pulling out of the dual plunger 78 more difficult. If the dual plunger 78 is pulled out of the storage chambers 2, 3, the latch noses 14 come into engagement with the retention portion 13, whereby the movement of the dual plunger 78 is inhibited. The latch noses 14 can only be pulled over the retention portion 13 by an increased exertion of force to completely remove the dual plunger from the storage chambers 2, 3.

A particularly stable cross-guide results by the embodiment having four grooves 11 per storage chamber 2 or 3 and four webs 12 per plunger 7 or 8 and torsional and bending moments can be introduced very easily into the wall of the storage chamber thereby.

It is particularly advantageous if each web 12 is respectively longer than the groove 11 cooperating with it. This means that the length L2 is larger than the length L1. The plungers 7, 8, and thus the pistons 71, 81, are guided even longer by this measure on the movement of the pistons 71, 81 in the direction of the outlets 21, 31 until, on this movement, the ends of the webs 12 facing the pressure plate 79 run out of the grooves 11 respectively associated with them.

To simplify the movement of the webs 12 out of the respective groove 11, said movement extending in the direction of the longitudinal axis A, i.e. to enable said movement with a smaller exertion of force, the grooves 11 are in particular configured as running out at their end disposed further in the storage chamber 2 or 3 (see FIG. 6). At their right ends in accordance with the drawing with respect to FIG. 6, the grooves 11 become slowly and constantly flatter in the axial direction so that the webs 12 can slide more easily out of the respective grove 11 in the axial direction. The same applies accordingly to the webs 12; they are also configured as running out with respect to the axial direction.

It has been proven in practice if the length L1 of each groove 11 amounts to at least 15%, and preferably to at least 20%, of the length of the respective storage chamber 2 and 3 respectively. All grooves 11 preferably have the same length L1.

All webs 12 preferably have the same length L2.

There are in principle two options for filling the dual dispensing apparatus 1. Either the storage chambers 2, 3 are filled through the outlets 21, 31 or they are filled from the proximal end.

In the first method, the dual plunger 78 is introduced into the storage chambers 2, 3 until the pistons 71, 81 contact the distal end 5 of the respective storage chamber 2, 3. The first component is now introduced through the first outlet 21 and the second component through the second outlet 31. The two pistons 71, 81 are moved back in the direction of the proximal end 4 by the inflowing components until the latch noses 14 come into engagement with the retention portion 13. The filling procedure is then ended and the outlets 21, 31 are closed by the closure cap 9.

In the second method, the dual plunger 78 is still not introduced into the storage chambers 2, 3. The first and the second storage chamber 2 and 3 respectively are filled with the first and second component respectively from the proximal end 4, with the outputs 21 and 31 being closed. The maximum filling height is reached when there is still a free space between the first or the second component and the retention portion which just corresponds in the axial direction to the height H of the pistons 71, 81 in the axial direction. The storage chambers 21, 31 can naturally also be filled less. After the filling, the dual plunger 78 is introduced into the storage chambers 2 and 3 and is moved forward until the latch noses 14 spring beyond the retention holder 13 and are latched there. In this process, the grooves 11 support the escape of the air on the introduction of the dual plunger.

On the emptying of the storage chambers 2, 3, i.e. on the dispensing of the two components through the outlets 21, 31 into the static mixer, the webs 12 engaging into the grooves 11 provide a secure and stable guidance of the pistons 71, 81. On the movement of the dual plunger 78 or of the pistons 71, 81 in the direction of the outlets 21, 31, the pistons 71, 81 are guided by the grooves 11 and the webs 12 for so long until the end of the webs 12 facing the pressure plate 79 runs out of the grooves 11. The height of the webs 12 and the elastic properties of the material from which the plungers 7, 8 and the storage chambers 2, 3 are produced are selected so that the webs 12 do not cause any leak along the piston when they slide along the wall of the storage chamber 2 or 3 after leaving the grooves 11.

The dual dispensing apparatus 1 in accordance with the invention is suitable, for example, for dual syringes 1 in which the filling volumes of the storage chambers 2, 3 amounts in each case to 25 ml.

In the embodiment described here, the two storage chambers 2, 3 have the same size and in particular the same diameter. This is in particular the case when the two components should be mixed in a ratio of 1 to 1. Such embodiments are naturally also possible in which the two storage chambers 2, 3 have different sizes and in particular different diameters with the same axial length. Such embodiments are advantageous for realizing other mixing ratios such as 2 to 1, 4 to 1 or 10 to 1.

The invention claimed is:

1. A dual dispensing apparatus for dispensing two flowable components having a first storage chamber for the first component, having a second storage chamber for the second component, wherein the two storage chambers are arranged next to one another and each have an outlet for the first or for the second component respectively at their distal ends, having a first plunger for penetrating into the first storage chamber and having a second plunger for penetrating into the second storage chamber, wherein a respective piston for dispensing the respective component is molded to each plunger and is sealingly guided by the respective wall of the storage chamber, characterized in that each storage chamber has at least one first guide element at its end remote from the outlet and each plunger has at least one second guide element adjacent to the respective piston, wherein the first and the second guide elements are configured for mutual engagement, wherein the first guide element comprises a groove in an inner wall of the storage chamber and the second guide element comprises a web which can engage the groove.

2. The apparatus of claim 1, wherein each web is in each case longer than the groove cooperating with it.

3. The apparatus of claim 1, wherein each plunger has four webs which are distributed equidistantly over the periphery of the plunger.

4. The apparatus of claim 3, wherein each storage chamber comprises four grooves, and wherein the four grooves are arranged offset by 90 degrees with respect to one another with respect to a peripheral direction.

5. The apparatus of claim 1, wherein each groove is configured as running out at its end facing the respective outlet.

6. The apparatus of claim 1, wherein the length (L1) of each groove amounts to at least 15% of the length of the respective storage chamber.

7. The apparatus of claim 1, wherein each outlet respectively has a circular cross-section.

8. The apparatus of claim 1, wherein the two outlets are part of a coupling device which is configured for cooperating with a static mixer or with a closure cap.

9. The apparatus of claim 8, wherein the coupling device is configured for a bayonet connection.

10. The apparatus of claim 8, wherein the coupling device includes encoding means which is configured for cooperating with encoding elements of a static mixer or of a closure cap.

11. The apparatus of claim 8, having a closure cap which is releasably connected to the coupling device and which closes the two outlets.

12. The apparatus of claim 8, having a static mixer which is releasably connected to the coupling device, wherein each outlet is connected to an inlet of the static mixer.

13. The apparatus of claim 1, wherein for each plunger, the web is arranged at an outer side of the plunger.

14. The apparatus of claim 1, wherein each of the first storage chamber and the second storage chamber has a retention portion at an end remote from its outlet and each of the first plunger and the second plunger has a plurality of latch noses at a periphery, wherein the retention portion cooperates with the latch noses in order to make an unintentional pulling out of the plunger more difficult.

15. The apparatus of claim 14, wherein the retention portion comprises a ring-shaped rib that projects into an inner space of the storage chamber.

* * * * *